US006450423B1

(12) United States Patent
Gurule

(10) Patent No.: US 6,450,423 B1
(45) Date of Patent: Sep. 17, 2002

(54) APPARATUS FOR REMOTE OPERATION OF SPRAY CANS

(76) Inventor: Randy F. Gurule, 1305 "C", Colton, CA (US) 92324

( * ) Notice: Subject to any disclaimer, the term of this patent is extended or adjusted under 35 U.S.C. 154(b) by 6 days.

(21) Appl. No.: 09/630,583

(22) Filed: Aug. 3, 2000

(51) Int. Cl.[7] ..... B05B 15/06

(52) U.S. Cl. ..... 239/531; 239/532; 239/333; 239/281; 222/174

(58) Field of Search ..... 239/333, 532, 239/531, 541, 578, 583, 280, 281; 222/174

(56) References Cited

U.S. PATENT DOCUMENTS 3,013,699 A * 12/1961 Meuwly ..... 222/174
3,069,095 A * 12/1962 Bishop ..... 239/281
3,220,613 A * 11/1965 Palmer et al. ..... 222/174
3,229,858 A * 1/1966 Lesh ..... 222/174
3,473,700 A * 10/1969 Batistelli ..... 222/174
3,510,028 A * 5/1970 Batistelli ..... 222/174
3,856,209 A * 12/1974 Hickson ..... 239/532
4,789,084 A * 12/1988 Yoshitomi ..... 239/532
4,886,191 A * 12/1989 Yoshitomi ..... 222/174
5,307,959 A * 5/1994 Bedore et al. ..... 222/174
5,779,155 A * 7/1998 Schennum ..... 239/333

* cited by examiner

*Primary Examiner*—Lesley D. Morris
*Assistant Examiner*—Dinh Q. Nguyen
(74) *Attorney, Agent, or Firm*—Sheldon & Mak

(57) ABSTRACT

A spray can remote control has a body holding and registering the can at a raised top wall portion, and a control mechanism including an actuator guided parallel to a nozzle axis of movement, a branched flexible lanyard for coupling a pull cord, flexible branches of the lanyard connected through a pair of guide rods to opposite ends of the actuator, whereby downward movement of the coupling produces corresponding downward movement of the guide rods and the actuator member without imparting side force to the nozzle button. Respective helical compression springs on the guide rods upwardly bias the actuator member, and stationary guides below the guide rods prevent side forces on the guide rods. The device also has an adjustable handle member, and a pair of sheaves for offsetting the lanyard to facilitate precise control with minimal frictional drag.

20 Claims, 2 Drawing Sheets

APPARATUS FOR REMOTE OPERATION OF SPRAY CANS

BACKGROUND

The present invention relates to the spray dispensing of fluids such as paint from pressurized containers, typically known as spray cans.

Spray cans are well known for the dispensing of paint. Such cans, although provided in various sizes, typically have a small button at the top that incorporates a spray nozzle, and a valve that is opened by depressing the button. Pressurized containers of the same type are also used for dispensing of other fluids such as lubricants, cleaners, solvents, and the like, as well as gaseous fluids. For example, one method for testing smoke detectors is to spray a test suitable gas at or into an installed detector, noting whether an alarm signal is activated.

It is also known to use handles of various lengths, and telescopic handles, in connection with roller painting. However, such handles would not work with spray cans in that they do not provide for depressing the button when the can is beyond the reach of a user thereof.

Accordingly, painters applying spray paint in elevated locations, and workers testing smoke detectors at ceiling level, are obliged to climb ladders or scaffolding to reach their targets.

Thus there is a need for a device that facilitates controlled operation of spray cans from locations beyond the reach of those using the spray cans, and that facilitates skillful operation by allowing precise control of the nozzle button.

SUMMARY

The present invention meets this need by providing a spray can holder for mounting on an extension handle, and a having a particularly effective actuator mechanism for the spray nozzle. In one aspect of the invention, an apparatus for holding and operating a spray can includes a body having a rear portion and a forwardly spaced longitudinal body axis; a receptacle rigidly connected proximate the upper extremity of the body for fixedly engaging a top wall of the spray can with a centrally located nozzle button concentric with the body axis and a spray axis of the nozzle button extending generally forwardly. A control mechanism of the apparatus includes an actuator member supported relative to the body and movably guided in a direction parallel to the body axis for contacting and actuating the nozzle button in alignment with the button axis, and means for connecting a remote control element to the actuator member for remotely effecting downward movement of the actuator member without imparting side force top the nozzle button. The apparatus also includes a rearwardly and downwardly projecting handle for manipulating the body and the spray can during operation of the remote control element.

Preferably the apparatus includes a movably supported elevator platform for engaging a lower portion of the reservoir and clamping the reservoir between the platform and the receptacle. The platform can be supported on a clamp screw that is located on the body axis and threadingly engaging the body proximate the lower extremity thereof.

Preferably the control mechanism also includes a flexible lanyard having a coupling for coupling to the remote control element, a pair of flexible branches of the lanyard extending upwardly from the coupling and being attached to a pair of guide rods that rigidly project from the actuator in parallel spaced relation on opposite sides of the body axis, whereby downward movement of the coupling produces corresponding downward movement of the guide rods and the actuator member by symmetrically applied forces.

Preferably the control mechanism further includes a first pair of guide elements supported relative to the body for guiding respective ones of the lanyard flexible members in line with and spaced below the guide rods for preventing side force from being applied to the guide rods by the lanyard. The control mechanism can also include a pair of sheaves rotatably mounted below the first guides and aligned therewith for smoothly supporting a medial portion of the lanyard in angularly offset relation to the guide rods. A second pair of stationary guide elements can guide respective lower portions of the lanyard flexible members in rearwardly offset relation to the body axis. The control mechanism can further include biasing means for upwardly urging the actuator member, and stop means for limiting upward movement of the actuator member. The biasing means can include compression springs mounted on the guide rods, the limiting means including each of the guide rods having a discontinuity thereon for limiting axial movement thereof relative to the body.

The handle can include a handle bracket projecting from the body, a handle member pivotally connected to the handle bracket and extending on handle axis in a plane intersecting the body axis, and a clamp for fixedly securing the handle member in a desired orientation relative to the body axis. Preferably the handle member is threaded for connecting an extension handle on the handle axis.

Preferably the apparatus further includes an elongate flexible member for use as the remote control element and having a connector element at one extremity thereof for connecting to the lanyard coupling. The apparatus can further include a cleat supported on the body and having divergent projections for supporting the flexible member in a storage condition thereof.

DRAWINGS

These and other features, aspects, and advantages of the present invention will become better understood with reference to the following description, appended claims, and accompanying drawings, where:

DESCRIPTION

Figure 1:
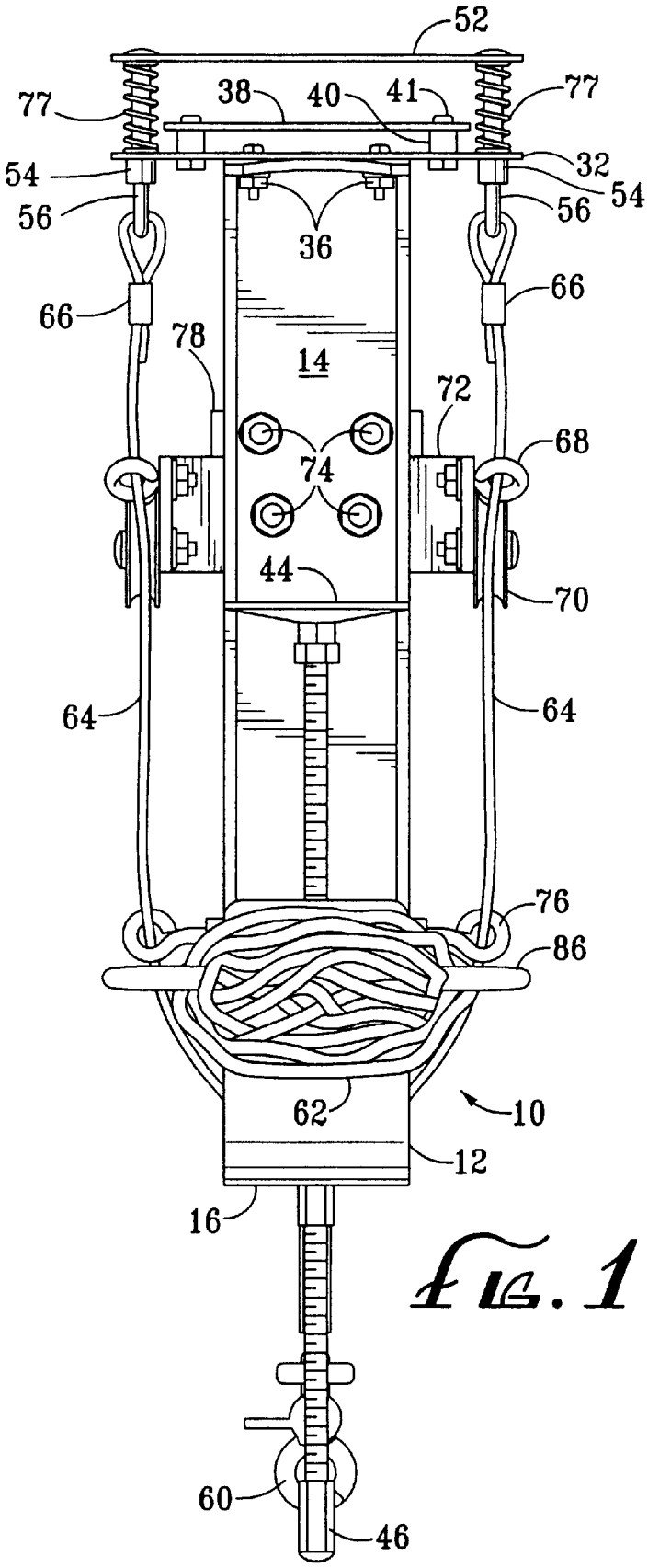
FIG. 1 is a front view of a spray can remote control apparatus according to the present invention.
Figure 2:
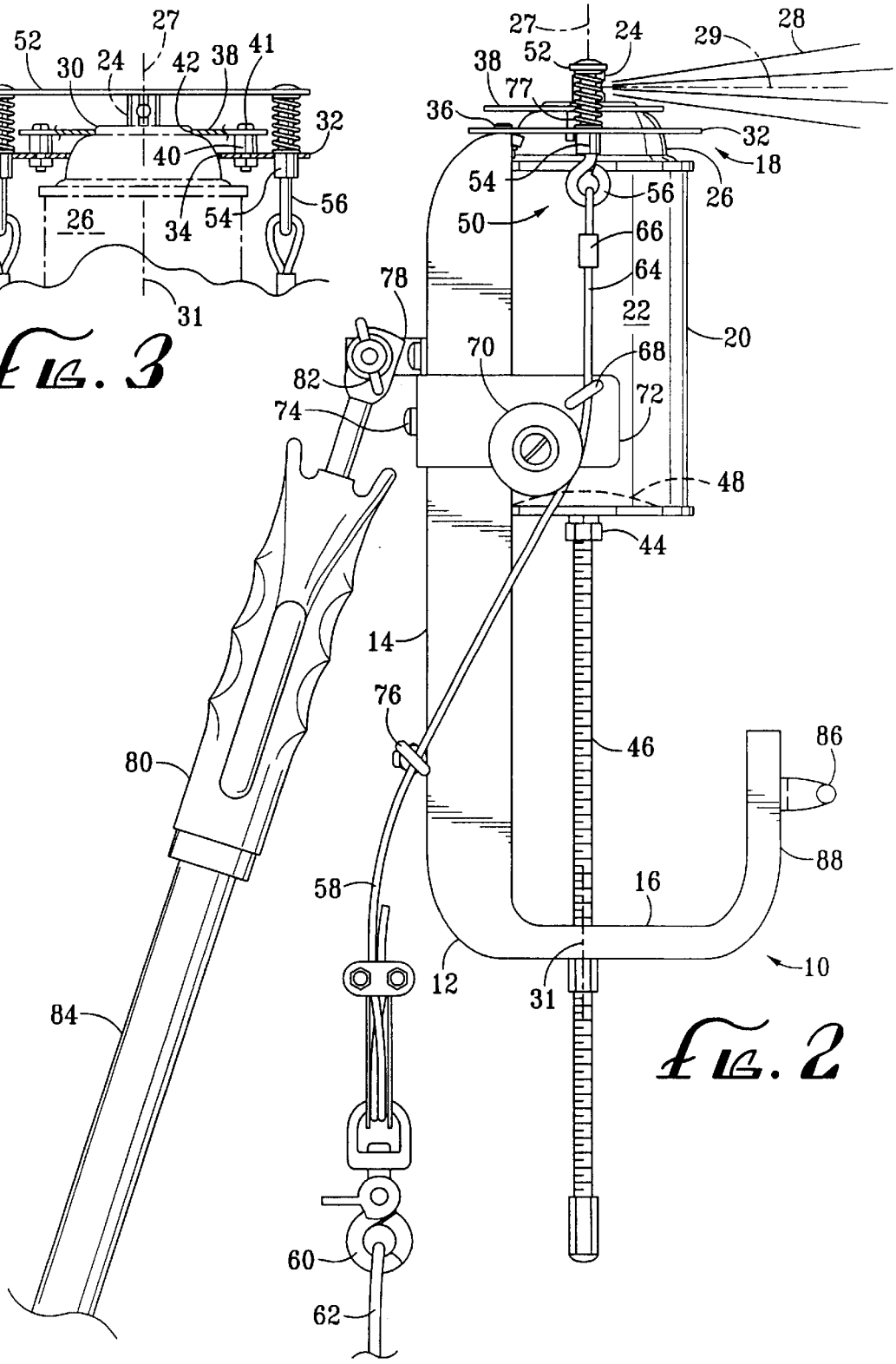
FIG. 2 is a side view of the apparatus of FIG. 1.

The present invention is directed to a spray can holder that is particularly effective for dispensing fluids to locations beyond the normal reach of users thereof. With reference to FIGS. 1 and 2 of the drawings, a spray can apparatus 10 includes a body 12 having a rear portion 14, and a projecting bottom portion 16, a receptacle 18 being rigidly fastened at an upper extremity of the rear portion 14 in forwardly projecting relation thereto for receiving an upper end of a pressurized spray can 20. The spray can 20 typically includes a pressurized reservoir 22, a nozzle button 24 projecting from a top wall 26 of the reservoir and movable downwardly on a button axis 27 in response to downward finger pressure to produce a spray pattern 28 generally on a nozzle axis 29 that is inclined approximately orthogonally relative to the button axis 27. Also, many commercially available spray cans, whether for dispensing paints, solvents, or other fluidic material, have a common configuration of the top wall 26 including a raised central portion 30 that is concentric with the button axis, the reservoir itself being circularly cylindrical and concentric with the button axis 27. The nozzle button 24 is upwardly biased by a suitable spring or other means (not shown) for lifting same to a closed or "off" position in the absence of downwardly applied force.

The receptacle 18 is configured for locating the spray can by engaging the upwardly projecting central portion 30 of the top wall 26 on a body axis 31 of the apparatus 10. In an exemplary configuration shown in the drawings, the receptacle 18 includes a lower plate 32 having a clearance opening 34 therein for receiving an upper portion of the spray can 20, the lower plate 32 being affixed to the body 12 by a laterally spaced pair of fasteners 36 such as rivets or screws. An upper plate 36 is mounted in parallel-spaced relation above the lower plate 32 on a laterally spaced pair of standoffs or spacers 40 by respective pairs of plate fasteners 41. The upper plate 38 has a receptacle opening 42 formed therein for locating the reduced diameter central portion 30 of the top wall 26 on the body axis 31. The spray can 20 is rigidly engaged with the receptacle 18 by an elevator platform 44 that is supported on a clamp screw 46, the clamp screw 46 threadingly engaging the bottom portion 16 of the body on the body axis 31. Thus the spray can 10 is clamped between the platform 44 and the upper plate 38 by tightening the clamp screw 46, the platform 44 contacting a recessed bottom wall 48 of the spray can.

Figure 3:
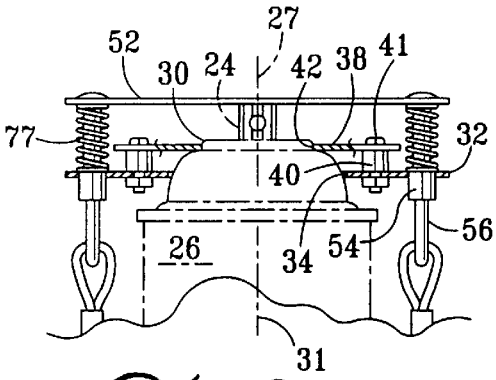
FIG. 3 is a fragmentary sectional view of a receptacle portion of the apparatus of FIG. 1.

A principal feature of the present invention is a control mechanism 50 by which the nozzle button 24 is remotely actuatable for finely controlled operation of the spray can 20 without producing objectionable side-loading of the button 24. The control mechanism 50 includes an actuator member 52 that is supported in parallel-spaced relation above the upper plate 38 and guided parallel to the body axis 31 as described herein. As best shown in FIG. 3, the lower plate 32 supports a pair of downwardly projecting guide bushings 54 that slidingly locate a pair of eye-rods 56, each eye rod 56 being rigidly fastened proximate a respective end of the actuator member 52 by suitable means such as riveting or resistance welding. A branched lanyard 58 is connected to the eye-rods 56, a lower extremity of the lanyard having an attachment coupling 60 for connecting a control cord 62 by which a user holding the apparatus 10 can remotely actuate the nozzle button 24. More particularly, respective flexible branches 64 of the lanyard 58 have attachments 66 at free extremities thereof by which the branches 64 are connected to respective ones of the eye-rods 56. Thus downward force applied to the lanyard 58 by the control cord 62 imparts symmetrical downward movement of opposite ends of the actuator member 52 against the nozzle button 24 for actuation thereof, the eye-rods 56 engaging the bushings 54 serving as guide pins for movement of the actuator member 52 parallel to the body axis 31, thereby avoiding unwanted side-loading of the nozzle button 24.

As further shown in the drawings, a pair of eye-shaped upper guide members 68 are fixedly supported relative to the body 12 below and in-line with the eye-rods 56 for insuring that forces imparted by the lanyard 58 to the eye-rods 56 are in axial alignment therewith, thereby limiting frictional drag associated with movement of the actuator member 52. Closely spaced below the upper guide members 68 are respective freely rotatable sheaves 70, the guide members 68 and the sheaves 70 being mounted on a U-shaped bracket 72 that is rigidly connected by a pair of bracket fasteners 74 to the body 12, opposite extremities of the bracket 72 projecting forwardly on opposite sides of the rear portion 14. Thus the coupling 60 of the lanyard 58 can be pulled simultaneously downwardly and rearwardly without appreciable side loading of the upper guide members 68. Further, a pair of lower guide members 76 are mounted to the rear portion 14 of the body 12, projecting from opposite sides thereof in-line with the sheaves 70 for supporting a medial portion of the lanyard 58 inclined in relation to the body axis 31. Finally, a pair of compression springs 77 are preferably interposed between the actuator member 52 and the guide bushings 54 for augmenting the internal upward biasing of the nozzle button 24. The springs 77 compensate for at least a portion of the moving weight of the control mechanism 50 and the control cord 62, and act to overcome the small amount of frictional resistance to upward movement of the actuator member 52. The springs 77 themselves contribute little, if any, to the friction in that they are located concentrically on the eye-rods 56 for avoiding induced side-loading. The above-described arrangement of the actuator member 52 guided by the parallel-spaced eye-rods 56 having branches 64 of the lanyard 58 connected thereto, in combination with the sheaves 70 and the upper and lower guides 68 and 76 advantageously provides for finely controlled operation of the nozzle button 24 with minimal frictional drag.

The inclusion of both the lower plate 32 and the upper plate 38 in the receptacle 18 advantageously provides preliminary guidance by the clearance opening 34 for the spray can 20 as it is being inserted, thereby facilitating engagement of the central portion 30 with the receptacle opening 42. Also, the distance of the guide bushings 54 below the upper plate 38 advantageously provides additional working length for the compression springs 77. It will be understood that the plates 32 and 38 can be combined with the spacers 40 in a unitary structure that may be either formed or molded.

The spray can apparatus 10 also includes a handle bracket 78 projecting rearwardly from the body 12 for adjustably connecting a handle member 80 by which the body 12 can be manipulated by a user who also controllably activates the nozzle button 24 by tensioning the lanyard 58. As best shown in FIG. 2, an exemplary form of the handle bracket is T-shaped with opposite arms thereof being fastened to the rear portion 14 of the body 12 by counterparts of the bracket fasteners 74, the handle member 80 being connected and adjustably clamped to a projecting portion of the bracket 78 by a wing-nut clamp 82. The handle member 80 is internally threaded in a conventional manner for attachment of a suitable extension handle 84 for use of the apparatus 10 beyond normal reach to the handle member 80 itself. Accordingly, the control cord 62 can be furnished in sufficient length corresponding to a maximum expected length of the extension handle 84, the body 12 having a cleat 86 or equivalent structure protecting therefrom on which to store unused portions of the control cord 62 as shown in FIG. 1, the cleat being mounted on a front portion 88 of the body 12 as best shown in FIG. 2.

The body 12 can be a molded plastic part, the back portion 14 having a C-shaped cross-section for enhanced rigidity, the bottom portion 16 also having a C-shaped cross-section. The threaded engagement with the clamp screw 46 can be with a suitable metallic threaded insert of the bottom portion 16. The lower plate 32, with or without the upper plate 38 and/or the U-shaped bracket 72 as well as the cleat 86 can be integrally formed with the body 12.

Although the present invention has been described in considerable detail with reference to certain preferred versions thereof, other versions are possible. For example, it is contemplated that a suitable lock washer be interposed between the handle bracket 78 and the handle member 80 for maintaining a desired angular relationship therebetween when the wing-nut clamp 82 is tightened. Also, the handle member 80 can be foreshortened, being formed as an internally threaded socket member for receiving the extension handle 84. Further, the handle bracket 78 can be oriented obliquely when it is desired to operate the spray can from a position laterally displaced from a surface to be sprayed. In this respect, it is further contemplated that the handle bracket 78 can be mounted so as to provide adjustable angular orientation. Moreover, a helical compression spring can be interposed between the bottom portion 16 of the body 12 and the elevator platform 44, a smooth rod being substituted for the clamp screw 46, the spray can 20 being biasingly held in engagement with the receptacle 18 by the spring, which surrounds the rod. Therefore, the spirit and scope of the appended claims should not necessarily be limited to the description of the preferred versions contained herein.

What is claimed is:

1. Apparatus for holding and operating a spray can having a cylindrical reservoir including a top wall having a nozzle button that is activated by downwardly applied force, and a bottom wall, the nozzle button being movable on a button axis for actuation thereof to generate spray generally on a spray axis, the spray axis being inclined relative to the button axis, the apparatus comprising:

(a) a body having upper and lower extremities and rear portion, a longitudinal body axis of the body being spaced forwardly from the rear portion;

(b) a receptacle rigidly connected proximate the upper extremity of the body for engagement by the top wall of the spray can with the button axis concentric with the body axis;

(c) means for holding the spray can with the top wall fixedly engaged with the receptacle and the button axis approximately concentric with the body axis, the spray axis extending generally forwardly;

(d) a control mechanism comprising:

(i) an actuator member supported relative to the body and movable in a direction parallel to the body axis for contacting the nozzle button to actuate same in alignment with the button axis without imparting side force to the nozzle button; and (ii) means for connecting a remote control element to the actuator member for remotely effecting downward movement of the actuator member by user-manipulation at user-selected distances along the remote control element without imparting side force to the actuator member relative to the body; and (e) handle means for manipulating the body, the handle means projecting from the rear portion of the body.

2. The apparatus of claim 1, wherein the means for holding the spray can comprises an elevator platform for engaging a lower portion of the reservoir, the platform being movably supported relative to the body on the body axis for clamping the reservoir between the platform and the receptacle.

3. The apparatus of claim 2, wherein the platform is supported on a clamp screw, the clamp screw being located on the body axis and threadingly engaging the body proximate the lower extremity thereof.

4. The apparatus of claim 1, wherein the handle means comprises a handle bracket projecting from the body, a handle member pivotally connected to the handle bracket, the handle member having a longitudinal handle axis in a plane intersecting the body axis, and a clamp for fixedly securing the handle member in a desired orientation relative to the body axis.

5. The apparatus of claim 4, wherein the handle member is threaded for connecting an extension handle on the handle axis.

6. The apparatus of claim 1, further comprising an elongate flexible member for use as the remote control element, and a pair of flexible members for connecting the remote control element to the actuator at spaced locations symmetrically on opposite sides of the body axis.

7. The apparatus of claim 6, further comprising a cleat supported on the body and having divergent projections for storing the flexible member in a storage condition thereof.

8. Apparatus for holding and operating a spray can having a cylindrical reservoir including a top wall having a nozzle button that is activated by downwardly applied force, and a bottom wall, the nozzle button being movable on a button axis for actuation thereof to generate spray generally or a spray axis, the spray axis being inclined relative to the button axis, the apparatus comprising:

(a) a body having upper and lower extremities and rear portion, a longitudinal body axis of the body being spaced forwardly from the rear portion;

(b) a receptacle rigidly connected proximate the upper extremity of the body for engagement by the top wall of the spray can with the button axis concentric with the body axis;

(c) means for holding the spray can with the top wall fixedly engaged with the receptacle and the button axis approximately concentric with the body axis, the spray axis extending generally forwardly;

(d) a control mechanism comprising:

(i) an actuator member supported relative to the body and movable in a direction parallel to the body axis for contacting the nozzle button to actuate same in alignment with the button axis; and (ii) means for connecting a remote control element to the actuator member for remotely effecting downward movement of the actuator member;

(e) handle means for manipulating the body, the handle means projecting from the rear portion of the body;

(f) a flexible lanyard having a coupling for coupling to the remote control element, a pair of flexible members extending upwardly from the coupling and having respective attachments at free extremities thereof;

(g) a pair of guide rods slidably supported relative to the receptacle in parallel spaced relation on opposite sides of the body axis, the actuator member being rigidly connected between the guide rods, each guide rod being connected to a respective one of the lanyard attachments, whereby downward movement of the coupling produces corresponding downward movement of the guide rods and the actuator member.

9. The apparatus of claim 8, further comprising a first pair of guide elements supported relative to the body for guiding respective ones of the lanyard flexible members in line with and spaced below the guide rods for preventing side force from being applied to the guide rods by the lanyard.

10. The apparatus of claim 9, further comprising a pair of sheaves rotatably mounted below the first guides and aligned therewith for smoothly supporting a medial portion of the lanyard in angularly offset relation to the guide rods.

11. The apparatus of claim 9, further comprising a second pair of guide elements supported relative to the body for guiding respective lower portions of the lanyard flexible members in rearwardly offset relation to the body axis.

12. The apparatus of claim 8, further comprising biasing means for upwardly urging the actuator member, and stop means for limiting upward movement of the actuator member.

13. The apparatus of claim 12, wherein the biasing means comprises a pair of compression springs, each of the springs being mounted on a corresponding one of the guide rods, and wherein the limiting means comprises each of the guide rods having a discontinuity thereon for limiting axial movement thereof relative to the body.

14. The apparatus of claim 8, further comprising an elongate flexible member for use as the remote control element and having a connector element at one extremity thereof for connecting to the lanyard coupling.

15. The apparatus of claim 14, further comprising a cleat supported on the body and having divergent projections for storing the flexible member in a storage condition thereof.

16. The apparatus of claim 8, wherein the means for holding the spray can comprises an elevator platform for engaging a lower portion of the reservoir, the platform being movably supported relative to the body on the body axis for clamping the reservoir between the platform and the receptacle.

17. The apparatus of claim 16, wherein the platform is supported on a clamp screw, the clamp screw being located on the body axis and threadingly engaging the body proximate the lower extremity thereof.

18. The apparatus of claim 8, wherein the handle means comprises a handle bracket projecting from the body a handle member pivotally connected to the handle bracket, the handle member having a longitudinal handle axis in a plane intersecting the body axis, and a clamp for fixedly securing the handle member in a desired orientation relative to the body axis.

19. The apparatus of claim 18, wherein the handle member is threaded for connecting an extension handle on the handle axis.

20. Apparatus for holding and operating a spray can having a cylindrical reservoir including a top wall having a nozzle button that is activated by downwardly applied force, and a bottom wall, the nozzle button being movable on a button axis for actuation thereof to generate spray generally on a spray axis, the spray axis being inclined relative to the button axis, the apparatus comprising:

(a) a body having upper and lower extremities and a rear portion, a longitudinal body axis of the body being spaced forwardly from the rear portion;

(b) a receptacle rigidly connected proximate the upper extremity of the body for engagement by the top wall of the spray can with the button axis concentric with the body axis;

(c) an elevator member for holding the spray can with the top wall fixedly engaged with the receptacle and the button axis approximately concentric with the body axis, the spray axis extending generally forwardly, the elevator member being movably supported relative to the body on the body axis for clamping the reservoir between the elevator member and the receptacle;

(d) a control mechanism comprising:

(i) an actuator member supported relative to the body and movable in a direction parallel to the body axis for contacting the nozzle button to actuate same in alignment with the button axis;

(ii) a flexible lanyard having a coupling for connecting a remote control element to the actuator member, a pair of flexible members extending upwardly from the coupling and having respective attachments at free extremities thereof;

(iii) a pair of guide rods slidably supported relative to the receptacle in parallel spaced relation on opposite sides of the body axis, the actuator member being rigidly connected between the guide rods, each guide rod being connected to a respective one of the lanyard attachments, whereby downward movement of the coupling produces corresponding downward movement of the guide rods and the actuator member;

(iv) a pair of helical compression springs, each of the springs being mounted on a corresponding one of the guide rods for upwardly urging the actuator member; and (v) a pair of guide elements supported relative to the body for guiding respective ones of the lanyard flexible members in line with and spaced below the guide rods for preventing side force from being applied to the guide rods by the lanyard; and (e) a handle member for manipulating the body, the handle member being adapted for rigidly connecting an extension handle on a longitudinal handle axis in a plane intersecting the body axis, the handle member being fixedly securable in a desired orientation relative to the body axis.

* * * * *